United States Patent [19]

Riedesser

[11] Patent Number: 4,984,589

[45] Date of Patent: Jan. 15, 1991

[54] WRAPPER FOR SMOKING ARTICLE

[75] Inventor: Walter Riedesser, Neustadt, Fed. Rep. of Germany

[73] Assignee: Julius Glatz GmbH

[21] Appl. No.: 444,036

[22] Filed: Nov. 30, 1989

[30] Foreign Application Priority Data

Nov. 30, 1988 [DE] Fed. Rep. of Germany ..... 3840329
Sep. 20, 1989 [EP] European Pat. Off. ..... 89117395

[51] Int. Cl.[5] ..... A24D 1/02
[52] U.S. Cl. ..... 131/365; 131/360
[58] Field of Search ..... 131/365, 360

[56] References Cited

U.S. PATENT DOCUMENTS 3,633,589 1/1972 Kahane .

FOREIGN PATENT DOCUMENTS 0133575 2/1985 European Pat. Off. .
2257317 5/1973 Fed. Rep. of Germany .
3721204 1/1988 Fed. Rep. of Germany .
2143150 5/1984 United Kingdom .

*Primary Examiner*—V. Millin
*Attorney, Agent, or Firm*—Toren, McGeady & Associates

[57] ABSTRACT

A cellulose wrapper for a smoking article includes a cover layer and at least one inner layer. The cover layer has an area weight of 20 to 60 g/m$^2$, a raw density of 0.5 to 0.9 g/cm$^3$, an air permeability of 10 to 250 CU, a filler material content in the range of 10 to 60 percent, and a burn promoting salt content in the range of 0 to 5 percent. The inner layer has an area weight of 6 to 20 g/m$^2$, a raw density of 0.7 to 1 g/cm$^3$, and an air permeability of 0 to 12 CU. The layers are wet laminated in a paper machine. Smoking articles with such a wraper do not experience a change in taste of the main smoke flow nor any spot development, and they afford an attractive ash tube or sheath. The time period for extinguishing the smoking article can be varied within wide limits. Moreover a drastic reduction of secondary smoke flow can be noted.

17 Claims, 1 Drawing Sheet

WRAPPER FOR SMOKING ARTICLE

BACKGROUND OF THE INVENTION

The present invention is directed to a wrapper for a smoking article, particularly for self-extinguishing cigarettes, formed of cellulose containing filler material and possibly burn promoting salts.

The dangers arising from smoking articles which are carelessly thrown away or which burn unobserved are well known. Both property insurance and life insurance statistics clearly underscore this fact. As a result, there has been no lack of attempts to produce smoking articles which extinguish themselves after a certain period of time.

In Patent Document EP-A-133 575, a cigarette is disclosed whose tobacco tube is wrapped with two different papers. Both papers are formed of cellulose and have approximately the same area weight of 20 to 25 g/m$^2$. The porosity of the inner paper is approximately 1 CU (Coresta Unit) and the porosity of the outer paper is approximately 55 CU. The inner paper is filled with 14 percent by weight titanium dioxide and the outer paper is filled with 30 percent by weight calcium carbonate and, in addition, has 6 percent by weight anhydrous potassium citrate. The low porosity of the inner paper is obtained by coating or impregnating with suitable water-soluble, film-forming materials, for instance, methylcellulose, carboxymethylcellulose, starch, chemically modified starch, gum guar, sodium alginate, dextrin, gelatin and the like. A cigarette with such a wrapper is supposed to extinguish itself within a few minutes, after it comes into contact with objects, such as pillows, carpets, furniture, for limiting the free access of oxygen to the glowing end or tip of the cigarette.

In addition to the solution using two paper layers, EP-A-133 575 also describes a solution using only one paper layer. Again, this is a light weight paper layer of approximately 20 to 25 g/m$^2$ area weight and a porosity of 1 to 4 CU, filled with titanium dioxide and/or calcium carbonate as filler material and 1.7 to 9 percent by weight anhydrous potassium citrate as a burn promoting salt.

Another advantageous feature of self-extinguishing smoking articles is that the so-called secondary smoke flow which stems from the glowing tip of the cigarette in the interval between draws on the cigarette is reduced. Secondary smoke flow is responsible, to a great extent, for so-called passive smoking. It would be desirable to suppress the formation of secondary smoke flow completely, however, its development is unavoidable, since smoking articles require a continuously burning glowing tip for readily appreciable reasons.

If the reduction of the secondary smoke flow is related to a reduction in the burning in the interval between two draws on a cigarette, this feature would be further advantageous in view of the rising prices of smoking articles.

Smoking articles with reduced secondary smoke flow enclosed or wrapped with two paper layers are known from the Patent Document DE-B-22 57 317. The inner layer is a highly porous cellulose fiber paper containing a finely powdered carbon, and alkali earth metal carbonates could also be added. The outer layer is a conventional cigarette paper. The inner layer, filled with carbon, may be glued so it can be held by the outer layer. In this known arrangement, the carbon in the inner paper layer absorbs the secondary smoke flow so that it is not visible without slowing down the burning of the tobacco.

Smoking articles, such as cigarettes, where the wrapper is a paper layer coated on the side facing the tobacco with a material for preventing the penetration of condensate or tar and the resultant formation of brown spots, is known from the Patent Document GB-A-21 43 150. Ethylene vinyl acetate (EVA), polyvinyl acetate (PVA), polyvinyl alcohol (PVOH), carboxymethylcellulose (CMC), starch and nitrocellulose lacquer are suggested as the coating.

It has also been suggested to coat the paper with metal for the same purpose. One suggestion is to attach a low-melting point plastic foil under the paper wrapper.

In Pat. Document DE-A-37 21 204, cigarette papers are known containing a substantially water-insoluble and thermally resistant filler material in the cellulose starting material. Under smoking conditions, such filler material affords a surface in the web of at least 80 m$^2$ per square meter of the web and contains approximately 15 percent by weight of an alkali metal salt. The porosity is in the range of 5 to 30 CU.

Finally, a cigarette is known from U.S. Pat. No. 3,633,589 which is wrapped with two paper layers. The cover layer is a conventional porous cigarette paper with good burning characteristics and ash qualities. The inner layer is a practically non-porous paper. The inner layer burns more slowly than the cover layer and the tobacco. Accordingly, air must pass completely through the glowing cigarette tip at each draw. As a result, the main smoke flow is supposed to contain less air, produce a rich, pure smoking sensation, and thereby reduce the tendency of the smoker to inhale. Secondary smoke flow or self-extinguishing are not mentioned in this patent.

Unfortunately, wrappers for smoking articles suggested in the literature are supposed to enable a reduction of the secondary smoke flow and/or self-extinguishing, however, they have not been successful in practice. Suggestions of the addition of certain chemicals to the cigarette paper resulted in an adulteration of the tobacco taste. Moreover, decomposition products which are objectionable with respect to health occur in certain of the proposals.

In other instances, the wrappers have a visually unattractive appearance, either because they are colored gray or brown, or form gray or even black ashes, since no closed ash tube is formed and/or because condensate or tar penetrate and form unsightly brown spots.

Higher prices discourage the use of two different paper layers as the wrapper, because each smoking article must pass through a second processing step. Further, there is the risk that the outer layer will become detached from the inner layer, and the inner layer usually has an unattractive and artificial look because of its filler material contents and other chemicals which become visible and, as experience has shown, leads to rejection by the consumer.

SUMMARY OF THE INVENTION

Therefore, the primary object of the present invention is to provide a wrapper or sheath for smoking articles, particularly for self-extinguishing cigarettes, whereby the wrapper can be placed about the tobacco in a single step. Further, the wrapper has no condensate penetration, it forms a stable, white ash sleeve, and prevents, to a great extent, passage of the decomposition products of the chemicals in the wrapper into the main smoke flow.

In accordance with the present invention, the wrapper is formed of a cover layer and an inner layer. The two layers are laminated in a paper machine or a similar apparatus. The cover layer has an area weight in the range of 20 to 60 g/m$^2$, a raw density in the range of 0.5 to 0.9 g/cm$^3$, air permeability in the range of 10 to 250 CU (Coresta Units), filler material content in the range of 10 per cent to 60 percent and a burn promoting salt content in the range of 0 to 5 percent. The inner layer has an area weight in the range of 6 to 20 g/m$^2$, a raw density in the range of 0.7 to 1 g/cm$^2$, and an air permeability in the range of 0 to 12 CU (Coresta Units).

There is the advantage that only one paper web needs to be processed, so that the production of the smoking articles with the wrapper, according to the present invention, does not differ from the production of conventional smoking articles where a single working operation is required for enclosing the tube of tobacco. Further, there is greater freedom in the constituents of the paper layers, and the access of atmospheric oxygen to the tobacco behind the glowing cigarette tip is reduced due to the low number of pores and non-porosity of the inner layer. To the extent that the burning of the tobacco is practically stopped, the time period until automatic extinguishment of the cigarette takes place can be adjusted within wide limits by the adjustment of the remaining porosity in accordance with the contents of the filler materials and burn promoting salts in the cover layer and the inner layer. A homogeneous, defect-free white and uniform ash tube is formed due to the composite action between the inner layer and the cover layer. The decomposition products of the filler materials and chemicals in the cover layer cannot pass into the main smoke flow when the inner layer is non-porous.

The characteristics of the cover layer and the inner layer must be adapted to one another so that defect-free processing in the paper machine and any other equipment is possible. The shrinkage behavior of the cover and inner layers must be related to one another whereby a creaseless composite action is possible and the finished paper does not roll or twist and can be placed around the tobacco tube without difficulty.

In accordance with the present invention, a third paper layer can be placed on the inner surface of the inner layer as counter-lamination affording an advantageous development. In this arrangement, at least the mechanical characteristics of the third paper layer should correspond approximately to those of the cover layer.

In a preferred embodiment of the present invention, the cover layer has an area weight of 30 to 40 g/m$^2$, preferably approximately 35 g/m$^2$, with the inner layer having an area weight of 6 to 12 g/m$^2$, preferably 8 g/m$^2$. As a result, the inner layer can be kept very thin in comparison to the cover layer, whereby in practice there is no impairment of the good burn promoting characteristics of the cover layer. The self-extinguishing effect is assured by blocking the flow of oxygen into the tobacco burning zone behind the glowing tip of the cigarette.

Preferably, the air permeability of the cover layer is greater than 40 CU, for facilitating processing in the paper machine with the inner layer being smaller than 2 CU for improving the self-extinguishing feature. Ultimately, the lack of pores or the non-porosity of the combined layers is decisive.

The absorptive capacity of the cover layer is 12±2 mm/10 min, which is given as a preferred value, measured according to the Klemm method as set forth in DIN 53106. This characteristic is also useful for the defect-free processing in the paper machine. A further characteristic of significance is the value of the roughness of the cover layer in the range of 50 ±10 Bekk seconds.

Since in many instances it is desirable to enrich the smoke with fragrant and/or flavoring materials, it has been suggested in the prior art to coat the cigarette paper with tobacco dust, aromatic materials or other ingredients, with the coating applied by binding agents. As has been mentioned previously, however, binding agents usually cause an undesirable change in taste. Furthermore, such a coating led to problems due to the formation of dust and the impairment of the adhesion during further processing.

Instead, in accordance with the present invention, either the inner layer is filled with tobacco dust and/or aromatic materials, or these materials are placed between the cover layer and inner layer before they are laminated in the paper machine. In addition, these two methods could also be combined.

Preferably, the cover layer and inner layer are formed of chemical wood pulp, and the chemical wood pulp can be obtained from annual plants such as flax, hemp or esparto or from perennial plants such as pine, birch or eucalyptus or from a mixture of these fibers.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
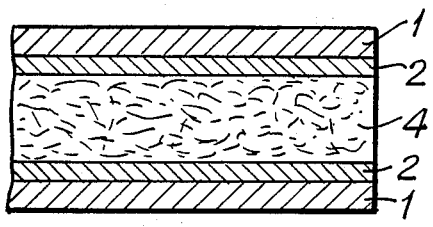
FIG. 1 is a partial longitudinal section through a cigarette illustrating a first embodiment of a wrapper incorporating the present invention.

FIG. 1 displays a sectional view through a cigarette with a double-layer wrapper. The paper wrapper encloses a tobacco tube 4 and comprises a cover layer 1 and an inner layer 2. The double layer is produced by wet lamination in a paper machine. The characteristics of such a cigarette are set forth in the following embodiments.

Figure 2:
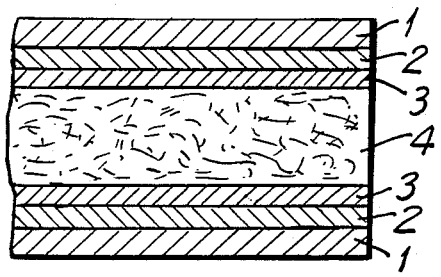
FIG. 2 a longitudinal section, similar to FIG. 1, through a cigarette displaying a second embodiment of the wrapper incorporating the present invention.

FIG. 2 is a sectional view through another cigarette with a triple-layer wrapper. The tobacco tube 4 is enclosed by a paper wrapper including an outer cover layer 1 and an inner or intermediate layer 2. The inner layer 2 is counter-laminated with a third paper layer 3 to avoid twisting or rolling of the paper. To achieve this purpose, the mechanical characteristics of the third paper layer 3 should correspond approximately to those of the cover layer 1. It can be appreciated that additional paper layers can be laminated together if desired and thus it is possible to adapt the constituents of the paper to any desired purpose in an optimum manner without the processing of the mechanical wrappers differing from the processing of conventional cigarette papers.

Tobacco dust, aromatic materials and other ingredients can be introduced between the different paper layers 1, 2, 3 which are laminated in the paper machine or in a comparable apparatus.

The characteristics of the paper layers 1, 2, 3 to be laminated together must be adjusted to one another, not only with respect to the intended purpose as a wrapper for smoking articles, particularly self-extinguishing smoking articles, but also with regard to processing in the paper machine which is as quick and free of defects as possible. All conditions can be met by the paper expert in view of the multiple-layer construction.

The steps which make it possible to control the time period until the smoking article goes out by itself are set forth in the following examples.

EXAMPLE 1

| | | |
|---|---|---|
| Inner layer 2: | | |
| 80% | bleached flax/hemp chemical pulp, degree of beating 92 degrees SR | |
| 12% | bleached eucalyptus chemical pulp | |
| 6% | calcium carbonate | |
| 2% | burn promoting salt sodium acetate | |
| | area weight | 8 g/m$^2$ |
| | raw density | 0.68 cm$^3$ |
| | air permeability | approximately 12 CU |
| Cover layer 1: | | |
| 8% | bleached pine sulfate chemical pulp, degree of beating 94 degrees SR | |
| 10% | bleached flax/hemp chemical pulp, degree of beating 92 degrees SR | |
| 38% | bleached esparto chemical pulp | |
| 40% | calcium carbonate | |
| 4% | burn promoting salt Na/K citrate 50:50 | |
| | area weight | 30 g/m$^2$ |
| | raw density | 0.67 g/cm$^3$ |
| | air permeability | 55 CU |
| | By means of wet lamination on the paper machine, a paper composite was produced with the following characteristics: | |
| | area weight | 38 g/m$^2$ |
| | raw density | 0.67 g/cm$^3$ |
| | air permeability | approximately 10 CU. |
| | The self-extinguishing time is approximately 300 seconds. | |

EXAMPLE 2

| | | |
|---|---|---|
| Inner layer 2: | | |
| 50% | bleached pine sulfate chemical pulp, degree of beating 94 degrees SR | |
| 47% | bleached flax/hemp chemical pulp, degree of beating 92 degrees SR | |
| 3% | calcium carbonate | |
| | area weight | 10 g/m$^2$ |
| | raw density | 0.7 g/cm$^3$ |
| | air permeability | approximately 8 CU |
| Cover layer 1: | | |
| 17% | bleached flax/hemp chemical pulp, degree of beating 12 degrees SR | |
| 40% | bleached eucalyptus chemical pulp | |
| 40% | calcium carbonate | |
| 3% | burn promoting salt Na/K citrate 50:50 | |
| | area weight | 35 g/m$^2$ |
| | raw density | 0.64 g/cm$^3$ |
| | air permeability | 40 CU |
| | By means of wet lamination on the paper machine, a paper composite was produced | |

-continued

| | | |
|---|---|---|
| | with the following characteristics: | |
| | area weight | 45 g/m$^2$ |
| | raw density | 0.67 g/cm$^3$ |
| | air permeability | 7 CU |
| | The self-extinguishing time is approxiamtely 150 seconds. | |

The self-extinguishing time is approximately 150 seconds.

EXAMPLE 3

| | | |
|---|---|---|
| Inner layer 2: | | |
| 100% | flax, degree of beating approximately 92 degrees SR, | |
| | area weight | 8 g/m$^2$ |
| | raw density | 0.7 g/cm$^3$ |
| | air permeability | approximately 2 CU |
| Cover layer 1: | | |
| 20% | flax, degree of beating approximately 92 degrees SR, | |
| 42% | esparto chemical pulp | |
| 33% | calcium carbonate | |
| 5% | burn promoting salt Na/K citrate 50:50 | |
| | area weight | 30 g/m$^2$ |
| | raw density | 0.67 g/cm$^3$ |
| | air permeability | 40 CU |

The self-extinguishing time is approximately 120 seconds.

EXAMPLE 4

| | | |
|---|---|---|
| Inner layer 2: | | |
| 100% | bleached pine sulfate chemical pulp, degree of beating 94 degrees SR | |
| | area weight | 12 g/m$^2$ |
| | raw density | 0.75 g/cm$^3$ |
| | air permeability | 0 CU |
| Cover layer 1: | | |
| 31% | bleached pine sulfate chemical pulp, degree of beating 94 degrees SR | |
| 25% | bleached eucalyptus chemical pulp | |
| 42% | filler material magnesium carbonate/calcium carbonate 30/70 | |
| 2% | burn promoting salt sodium acetate | |
| | area weight | 40 g/m$^2$ |
| | raw density | 0.72 g/cm$^3$ |
| | air permeability | 15 CU |

By means of wet lamination on the paper machine, a paper composite was produced with the following characteristics:

| | |
|---|---|
| area weight | 52 g/m$^2$ |
| raw density | 0.76 g/cm$^3$ |
| air permeability | 0 CU. |

The self-extinguishing time is approximately 90 seconds.

Since an average smoker draws on his cigarette every 40 seconds, a sufficient time period is available to prevent the cigarette from going out on its own. Moreover, the time period until the glowing cigarette tip goes out can be influenced by the diameter, the degree of packing of the tobacco, and the type of tobacco.

In each case, a reduction of secondary smoke flow could be observed. This reduction was greater for the shorter self-extinguishing times. In a cigarette with a wrapper, according to Example 3, the secondary smoke flow could be reduced from 20.2 mg in a standard cigarette to 5.7 mg in a test cigarette, that is, by approximately 75%. Using a wrapper, according to Example 4, the secondary smoke flow could be reduced from 24.7 mg in a standard cigarette to 4.3 mg in the test cigarette, that is, by approximately 82%. It is possible to attain different secondary smoke flow reductions in cigarettes with identical self-extinguishing times by a suitable variation of the constituents of the paper.

The condensate, nicotine and carbon monoxide values in the main smoke flow are controlled by means of the tobacco mixture, the weight of the tobacco, suitable cigarette filters and ventilation mouthpieces.

While specific embodiments of the invention have been shown and described in detail to illustrate the application of the inventive principles, it will be understood that the invention may be embodied otherwise without departing from such principles.

I claim:

1. Wrapper for an article to be smoked, such as a self-extinguishing cigarette, formed from cellulose, comprising filler materials, possibly including burn promoting salts, wherein the improvement comprises that the wrapper includes at least two paper layers comprising a cover layer (1) and an inner layer (2) laminated together, said wrapper comprises

| | |
|---|---|
| said wrapper comprises | |
| area weight | 20–60 g/m$^2$ |
| said cover layer (1) comprises | |
| [area weight | 20–60 g/m$^2$] |
| raw density | 0.5–0.9 g/cm$^3$ |
| air permeability | 10–250 CU (Coresta Units) |
| filler material content | 10–60% |
| burn promoting salt content | 0–5% |

and the inner layer (2) comprises:

| | |
|---|---|
| area weight | 6–12 g/m$^2$ |
| raw density | 0.7–1 g/cm$^3$ |
| air permeability | 0–12 CU (Coresta units). |

2. Wrapper, as set forth in claim 1, having an area weight of 30–40 g/m$^2$.

3. Wrapper, as set forth in claim 2, having an area weight of approximately 35 g/m$^2$.

4. Wrapper, as set forth in claim 1, wherein the cover layer (1) has an air permeability grater than 40 CU.

5. Wrapper, as set forth in claim 1, wherein the cover layer (1) has a filler material content of 30–45%.

6. Wrapper, as set forth in claim 5, wherein the cover layer (1) has a filler material content of approximately 35%.

7. Wrapper, as set forth in claim 5, wherein the filler materials comprise at least one of calcium carbonate and magnesium carbonate.

8. Wrapper, as set forth in claim 6, wherein the filler materials comprise at least one of calcium carbonate and magnesium carbonate.

9. Wrapper, as set forth in claim 1, wherein said cover layer (1) has an absorptive capacity of 12±2 mm/10 min, as measured according to the Klemm method set forth in DIN 53105.

10. Wrapper, as set forth in claim 1, wherein said cover layer (1) has a roughness of 50±10 Bekk seconds.

11. Wrapper, as set forth in claim 1, wherein said inner layer (2) comprises up to 6% filler material and up to 2% burn promoting salt.

12. Wrapper, as set forth in claim 1, wherein said inner layer (2) has an area weight of 8 g/m$^2$.

13. Wrapper, as set forth in claim 1, wherein said inner layer (2) has an air permeability range of 0–2 CU.

14. Wrapper, as set forth in claim 1, wherein said inner layer (2) is filled with at least one of tobacco dust and aromatic materials.

15. Wrapper, as set forth in claim 1, wherein at least one of tobacco dust and aromatic materials are placed between the cover layer (1) and the inner layer (2).

16. Wrapper, as set forth in claim 1, wherein a third paper layer (3) is counter-laminated to a surface of said inner layer (2) opposite a surface thereof laminated to said cover layer (1).

17. Wrapper, according to claim wherein said wrapper formed of cellulose comprises at least one of flax, hemp, esparto, pine sulfate and eucalyptus chemical pulp.

* * * * *